US009428925B2

(12) United States Patent
Rampling

(10) Patent No.: US 9,428,925 B2
(45) Date of Patent: Aug. 30, 2016

(54) TOOL

(71) Applicant: SCOTT CUTTERS LIMITED, Marlow Buckinghamshire (GB)

(72) Inventor: Scott Rampling, Marlow Buckinghamshire (GB)

(73) Assignee: Scott Cutters Limited, Marlow (GB)

( * ) Notice: Subject to any disclaimer, the term of this patent is extended or adjusted under 35 U.S.C. 154(b) by 0 days.

(21) Appl. No.: 14/422,144

(22) PCT Filed: Jul. 26, 2013

(86) PCT No.: PCT/GB2013/052002

§ 371 (c)(1),
(2) Date: Feb. 17, 2015

(87) PCT Pub. No.: WO2014/027177

PCT Pub. Date: Feb. 20, 2014

(65) Prior Publication Data

US 2015/0225967 A1 Aug. 13, 2015

(30) Foreign Application Priority Data

Aug. 17, 2012 (GB) ..... 1214725.2
Jun. 3, 2013 (GB) ..... 1309878.5

(51) Int. Cl.
*E04F 21/08* (2006.01)
*E04F 21/16* (2006.01)

(52) U.S. Cl.
CPC ..... *E04F 21/08* (2013.01); *E04F 21/163* (2013.01); *Y10T 29/49826* (2015.01)

(58) Field of Classification Search
CPC ..... E04F 21/16; E04F 21/161; E04F 21/162; E04F 21/163; B05C 17/005; B05C 17/10
See application file for complete search history.

(56) References Cited

U.S. PATENT DOCUMENTS 3,878,581 A * 4/1975 Perna ..... E04F 21/06 15/235.3
4,654,919 A 4/1987 Liberman
4,946,360 A 8/1990 Brown
5,351,357 A * 10/1994 Liberman ..... E04F 21/06 15/245

(Continued)

FOREIGN PATENT DOCUMENTS

EP 2 289 637 A1 3/2011
EP 2 308 606 A1 4/2011

(Continued)

OTHER PUBLICATIONS

International Search Report and Written Opinion of the International Searching Authority, mailed Feb. 17, 2014 in PCT/GB2013/052002, 12 pages.

(Continued)

*Primary Examiner* — Shay Karls
(74) *Attorney, Agent, or Firm* — Lewis Roca Rothgerber Christie LLP

(57) ABSTRACT

A tool 1 comprises a handle and a tool blade mounted on the handle. The blade comprises a flexible web member 2 formed of a polymer and having two opposite generally flat side surfaces and a substantially straight free edge. A strip 15 of spring steel is fixed to the web on one side surface and extends along the outer part only of the web adjacent to the free edge thereof such that a portion of the web between the handle and the strip remains uncovered by the strip.

17 Claims, 8 Drawing Sheets

(56) References Cited

U.S. PATENT DOCUMENTS

| | | | | |
|---|---|---|---|---|
| 6,616,520 | B1 * | 9/2003 | Kawahara | B24B 37/22 451/534 |
| 2005/0087084 | A1 * | 4/2005 | Gray | B41F 15/42 101/123 |

FOREIGN PATENT DOCUMENTS

| | | | |
|---|---|---|---|
| FR | 2 969 192 | A1 | 6/2012 |
| WO | WO 94/03095 | A1 | 2/1994 |
| WO | WO 2007/135247 | A1 | 11/2007 |
| WO | WO 2009/026679 | A1 | 3/2009 |
| WO | WO 2013/001277 | A2 | 1/2013 |

OTHER PUBLICATIONS

UK Search Report dated Feb. 13, 2014 in priority application GB 1309878.5, 3 pages.

UK Search Report dated Nov. 30, 2012 in priority application GB 1214725.2, 3 pages.

* cited by examiner 15
2
20
21

2
15
5
8
6
7
4
3

TOOL

CROSS-REFERENCE TO RELATED APPLICATIONS

This application is a National Stage of PCT/GB2013/052002 filed on Jul. 26, 2013, which claims priority to and the benefit of British application Nos. 1309878.5, filed Jun. 3, 2013 and 1214725.2, filed Aug. 17, 2012, the entire contents of all of which are incorporated herein by reference.

The invention relates to a tool and in particular a tool used for applying, smoothing, leveling and polishing plaster applied to a surface ie wall or ceiling. In addition it can be used for the application and smoothing of Jointing Compounds and decorative finishes. The tool blade encompasses a combination of correct materials for a particular application and its different working stages. It allows improved flexibility to speed up both working and chemical processes at the same time enhancing the finish of the surface, particularly on uneven surfaces. Incorporating different working materials on opposing sides of the tool facilitates improved finish and working times. The tool blades are also easily interchangeable making the tool versatile and economical to maintain.

Conventionally, plaster is applied to walls and ceilings using a plastering trowel which comprises a flat rectangular stainless steel sheet having dimensions of about 280 mm to 460 mm by 120 mm with a generally cylindrical handle mounted spaced from and parallel to the sheet. The same tool is used for smoothing and leveling the plaster once it has been applied. After it has dried a little, the tool is then used to polish the plaster to a smooth finish.

A known plaster "ruling off" leveling tool, known as a 'Darby', comprises an extruded aluminum elongate body which may be hollow or solid. The known tool sometimes has a pair of spaced handles extending perpendicularly there from. The spacing of the handles is adjustable in some cases. However, the 'Darby' tool, being generally rigid and inflexible, is only useful for "ruling off" and leveling backing plaster (first coat plaster) or scratch coat sand and cement render (first coat render).

The invention provides a tool comprising a handle and a generally rectangular tool blade mounted on the handle, wherein the tool blade comprises a rectangular web member formed of flexible material having two opposite flat side surfaces and at least one straight free edge; wherein a strip of a different material is fixed to the web on one side thereof and extends along the outer part only of the web adjacent to the free edge thereof.

The invention has particular application in a tool for applying plaster to a surface such as a wall. The web is formed from a polymer and provides flexibility. One side of the web can be used for applying and generally leveling and smoothing the plaster and the other side, provided with the strip of a different material such as spring steel, can be used, subsequently, for polishing the plaster surface to a smooth finish.

Embodiments of the inventions are described below with reference to the accompanying drawings, in which.

Figure 1:
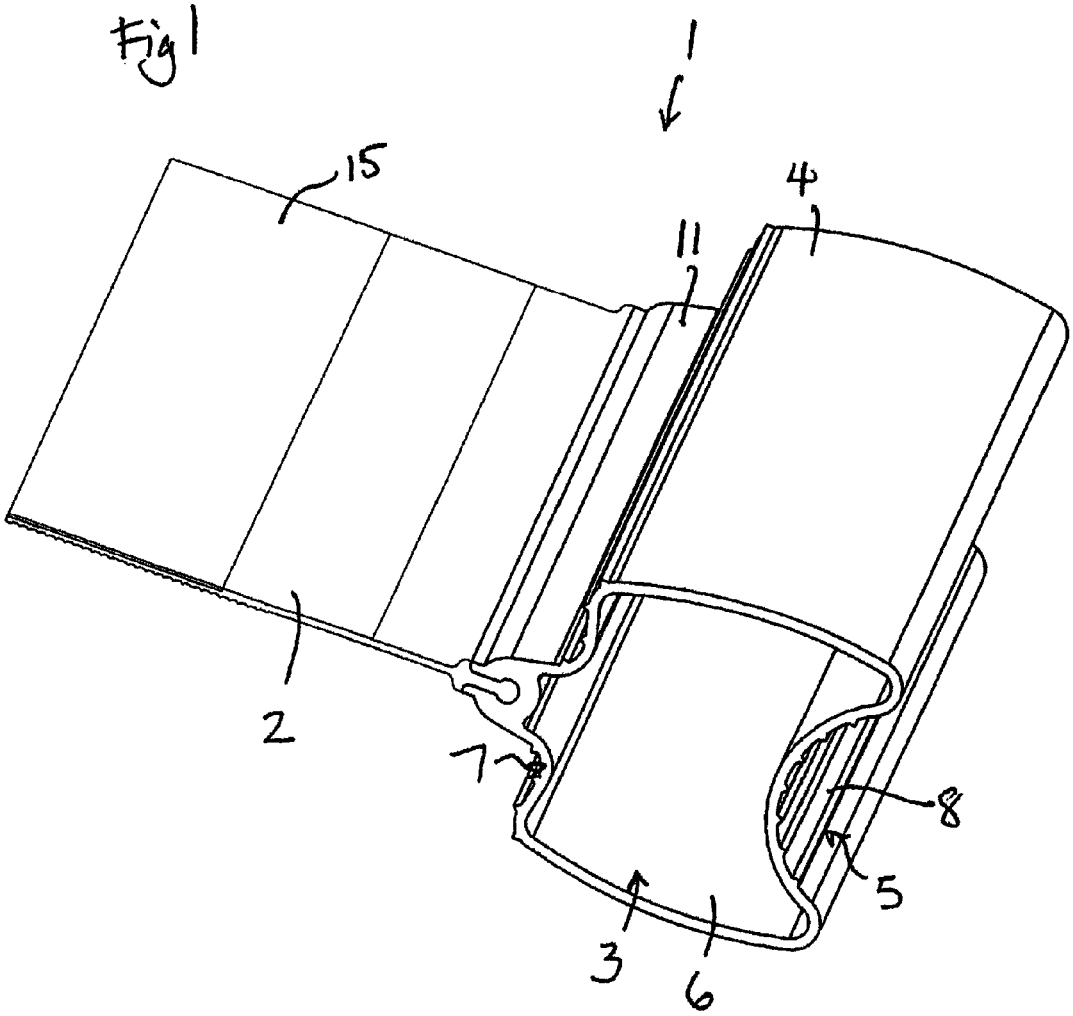
FIG. 1 is a perspective view, from above, showing a short end portion of the tool.
Figure 2:
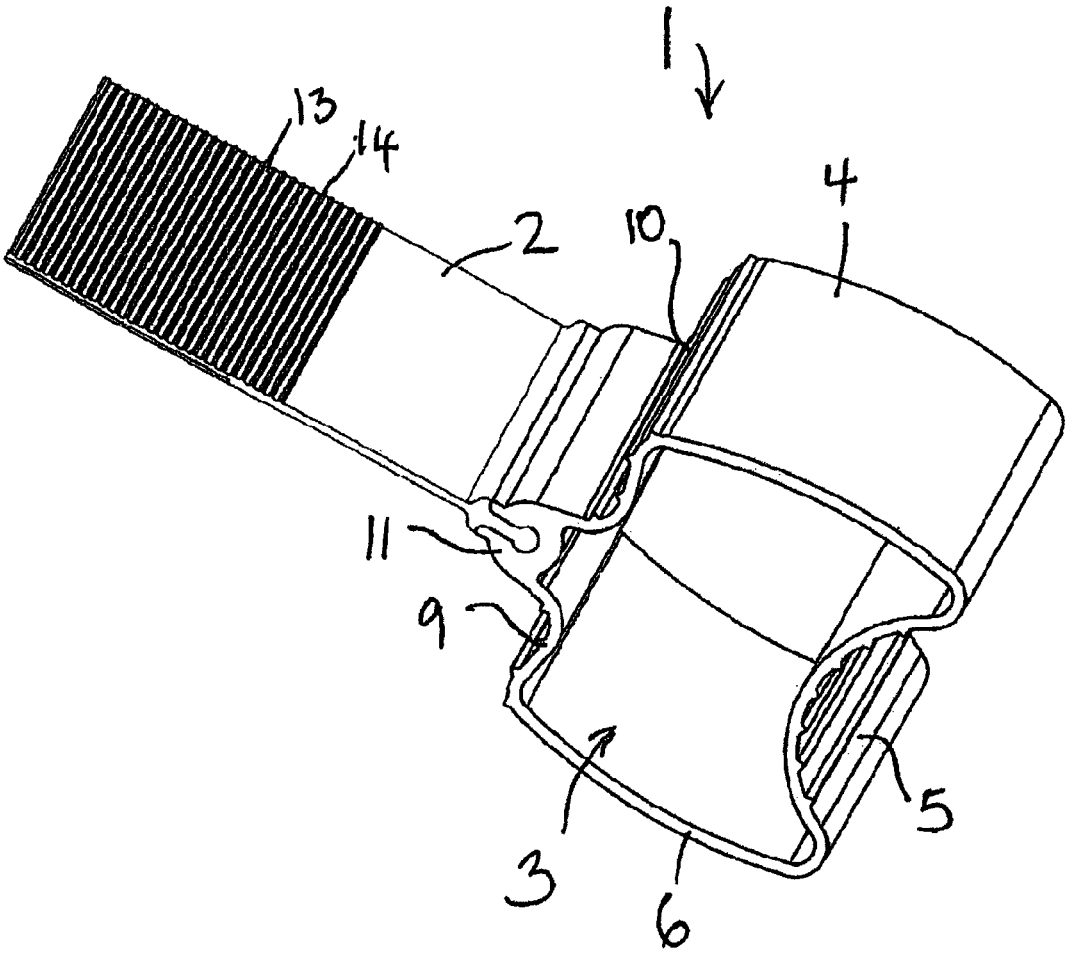
FIG. 2 is a perspective view, from below, showing a short end portion of the tool.

FIGS. 1 to 5 show a short portion of a long tool 1 having particular application for smoothing, leveling and polishing finish coat plaster applied to a surface such as a wall or a ceiling. The tool comprises a plaster engaging blade in the form of an elongate, generally rectangular, flat, flexible web 2 having two opposite flat side surfaces which is joined to a substantially rigid, elongate handle 3 which extends along substantially the entire length of one long edge of the web. The handle 3 has a cross-sectional profile which is substantially constant along its length and is thereby adapted to be gripped by the user at any point along its length. The profile is also symmetrical so that it can be gripped from either side.

The tool may have any length, depending on the application. A tool for smoothing, leveling and polishing plaster may have a length up to 2000 mm or even longer. Lengths between 100 to 1800 mm have been found particularly useful. The width of the web is preferably 60 to 100 mm, most preferably about 85 mm.

In the preferred embodiments, the web 2 is an extrusion formed of a rigid or semi rigid PVC or other suitable polymer or elastomer and has a thickness of between 1.0 and 3.0 mm, preferably about 1.7 mm. This gives the web sufficient stiffness and flexibility to operate efficiently.

The handle 3 is a hollow extrusion formed of aluminium and is substantially rigid. The handle has a generally rectangular profile comprising a first side 4 which is generally parallel to the web, a second side 5, generally perpendicular to the web, a third side 6 parallel to the first side and a fourth side 7 parallel to the second side. The second side 5 is formed in a concave profile providing a curved recess 8 extending along the handle and adapted to receive the thumbs of the user. The fourth side 7 is provided with two concave recesses 9 and 10 extending along the length of the handle and adapted selectively to receive the fingertips of the user. The ergonomic design of the handle allows it to be comfortably gripped by the user at all times and especially when working overhead.

The handle 3 is provided with a bifurcated flange 11 at the junction between the web and the fourth side 7 of the handle and extending generally in the plane of the web 2. The limbs of the flange define a recess in the form of a channel which extends along the length of the handle. The recess receives and holds the edge portion of the web. Shoulders are formed on the web to abut the ends of the limbs. In one embodiment (not shown) the recess receives the edge portion as a snap fit by virtue of barbed formations in the recess and on the portion.

The edge portion of the web has an enlarged section 12 running therealong which is held in a complimentary enlarged section of the recess. The enlarged sections of the web and the recess are in the form of a ball and socket when viewed in cross-section. Preferably, the edge portion of the web is received and held in the recess in a slack fit having a nominal clearance all round the edge portion of about 0.125 mm at about 20° C. The shapes and dimensions of the web and recess, and in particular, the loose or slack fit, permit sliding movement of the edge portion of the web along the length of the recess but prevent movement of the web out of the recess in the direction perpendicular to the length of the recess. In this embodiment, the web is fitted to the handle by sliding the edge portion of the web into and along the recess on the handle.

The loose or slack fit of the edge of the web in the handle serves various functions. Firstly, it allows the web to expand differentially to the linear expansion of the handle. This is especially important where the handle and web are made of different materials since without this facility the web might expand more than the handle under ambient conditions. If the web is held rigidly in the handle, it may tend to kink or buckle along its length making it difficult or impossible to use correctly. Secondly, this arrangement enables simple replacement of a worn or damaged web into a handle. Other web profiles of rigid or semi-rigid design may be introduced for other different tasks to be performed.

Figure 5:
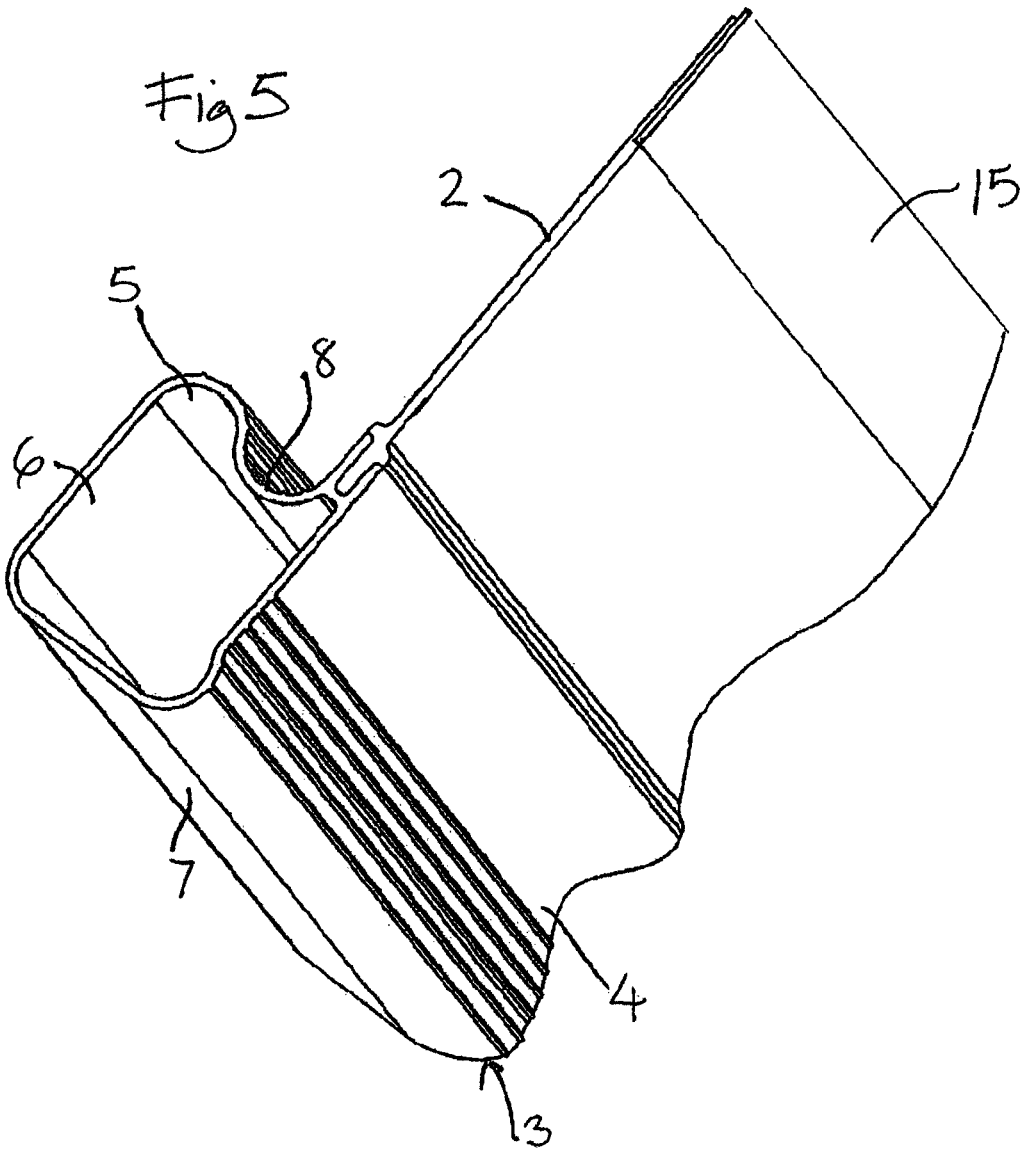
FIG. 5 is a perspective view, showing a short end portion of another variant of the tool.

The lower surface of the web is used for smoothing and leveling wet finish coat plaster applied to a wall or other surface and is formed with a plurality of parallel grooves 13 extending along the length thereof and defining parallel ridges 14 therebetween. The ridges and the flat grooves therebetween are best seen in FIG. 5. This ridged surface helps to hold onto the plaster/material and distribute it evenly across peaks and troughs in the uneven substrate surface, thus facilitating an improved flatter finish. The use of PVC or material of similar soft properties reduces sound vibration which significantly reduces the amount of moisture brought to the surface of the plaster in this part of the operation. This results in a speeding up of the chemical reactions within the plaster and subsequent acceleration of the overall drying times. In addition the ridges also hold the surplus plaster on the tool during the operation preventing mess and spillage. The series of ridges along the surface strengthen the web but allow a slender profile and flexibility.

A rectangular strip of material 15 is connected to the web on the upper side surface thereof and extends along the outer part only of the web adjacent to the straight free edge thereof such that a portion of the web between the handle and the strip remains uncovered. The strip extends along the tool parallel to the handle.

The strip is formed of a different material to that of the web. In a preferred embodiment, the strip is metal and preferably spring steel, ideally spring stainless steel. In an alternative, other materials different to that of the web may be used for the strip such as other polymers or elastomers such as rubber or silicone and the two materials making up the web may be co-extruded to form the web.

Figure 3:
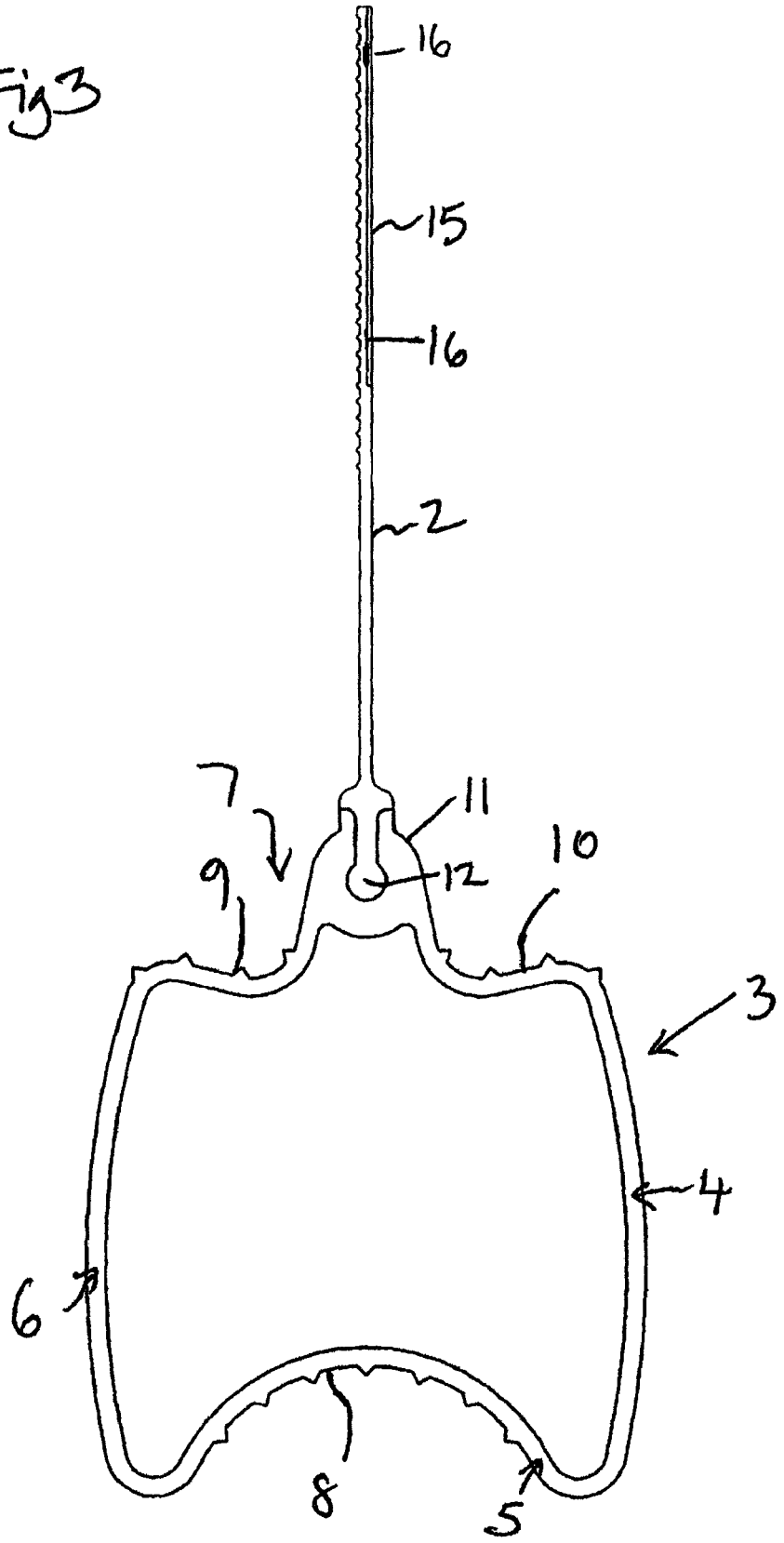
FIG. 3 is an end view of the tool.

The web is rebated along one side adjacent to its free edge to receive the strip such that the side surface of the strip is flush with the remaining side surface of the web. The strip may be attached by any suitable means such as by gluing or being held onto the web by the web being moulded thereto. If the strip is glued to the web, a pair of recesses 16 may be provided in the web as shown in FIG. 3 to receive a suitable waterproof glue or double sided waterproof glue tape.

The thickness of the strip may be from about 0.1 mm to about 1.00 mm. The preferred thickness is generally 0.25 mm. The use of film or foil material can also be used in the correct application.

As shown, a strip is provided on only one surface of the web. In this tool, the ridged side of the tool is used for smoothing and leveling plaster and the opposing surface, provided with the metal strip at the edge, is used for applying, finishing and polishing the plaster. The different surface textures of the different materials make them suitable for these different operations. The width of the strip and also the opposing ridged portion need only be about 15 mm from the edge since only that portion of the blade contacts the plaster. The widths of the strip and the ridged portion are preferably 10 mm to 30 mm. Because the strip extends only along an outer part of the web, it does not seriously reduce the flexibility of the web.

In an alternative embodiment, not shown, a strip may be provided on both surfaces of the web. In this case, both surfaces of the web will be used for finishing and polishing plaster. In a further embodiment, not shown, a strip may serve as a tip on one side of the blade but be counter-balanced by a similar strip on the opposing side. The counter-balancing strip can be situated slightly away from the edge (approx 15 mm) so as not to interfere with the desired working edge material on this counter-balanced side. This feature in the correct application can enhance stability and ensure the blade remains straight. In another embodiment, not shown, the tool can be adapted to accept two blade combinations on either side of the handle as a multi-tool.

Figure 4:
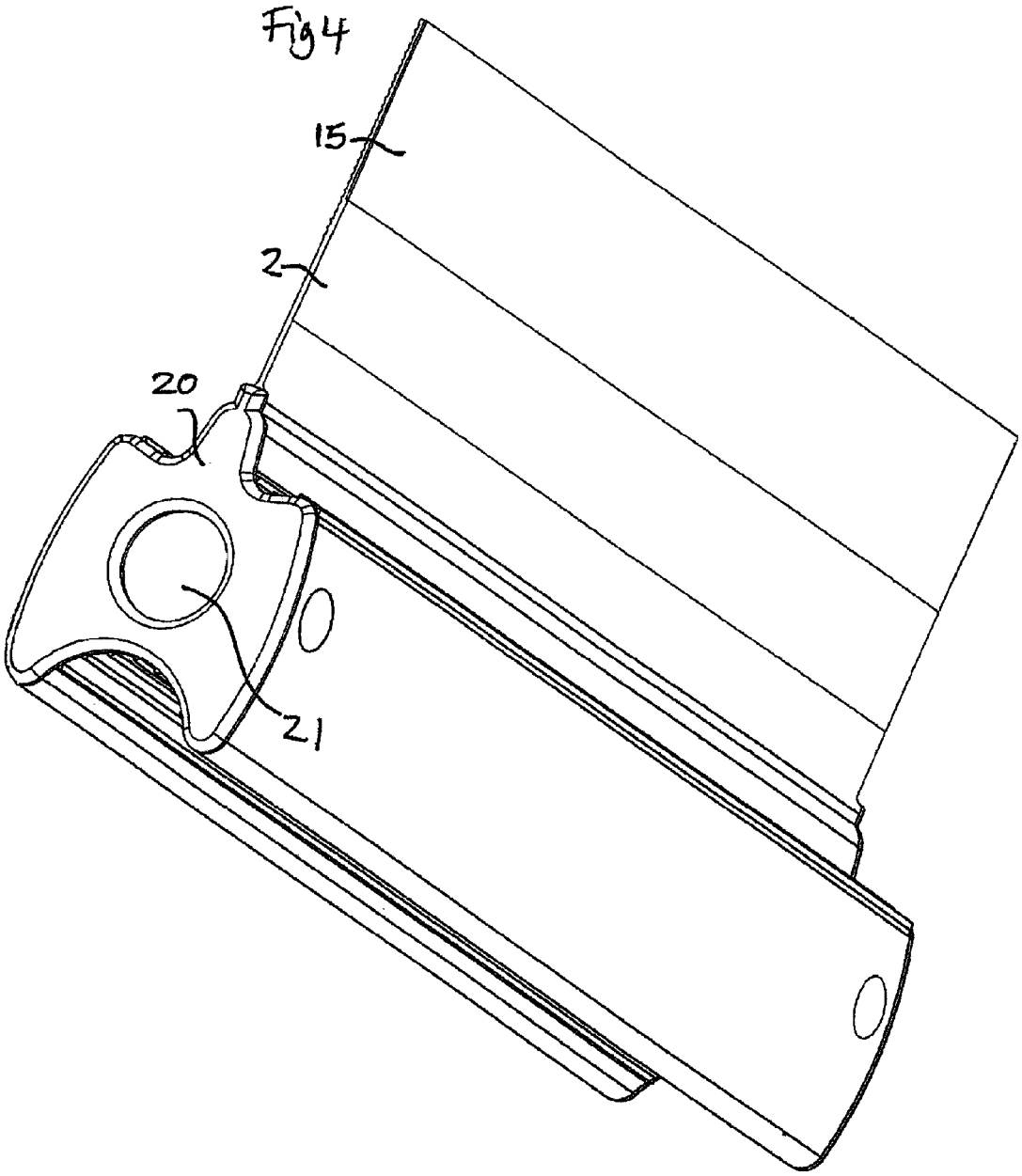
FIG. 4 is a perspective view, from above, of an end portion of the tool with an end cap in place.

The hollow body of the handle is closed by end caps as shown in FIG. 4.

FIG. 4 shows an end portion of the handle 3 with an end cap 20 which is a push fit into the open end of a hollow extruded handle and is retained by catches snapping into apertures. The end cap has an opening 21 which permits drainage of water from within the hollow handle. A portion of the end cap overlies the flange 11 and closes the open end of the recess to retain the web in place. The opening 21 may be closed by a removable plug. A plastic cover may be provided to protect the strip when the tool is not in use. The plastic cover may be stored inside the handle when the tool is in use, by inserting it through the opening 21.

FIG. 5 shows the tool with a differently shaped handle. In this variant, the handle 3 is a hollow extrusion formed of aluminum and is substantially rigid. The handle has a generally rectangular profile comprising a first side 4 which is generally co-planar with the web, a second side 5, generally perpendicular to the web, a third side 6 parallel to the first side and a fourth side 7 parallel to the second side. The second side 5 is formed in an S profile providing a curved recess 8 extending along the handle and adapted to receive the fingertips of the user. The ergonomic design of the handle allows it to be comfortably gripped by the user at all times and especially when working overhead.

The metal strip is fixed to the web on the face of the web opposite to the side 5 of the handle having the recess 8. As can be seen, in the blade shown here, the strip extends outwardly slightly beyond the free edge of the web.

As before, the handle 3 is provided with a bifurcated flange at the junction between the first and second sides 4, 5 of the handle and extending generally in the plane of the web 2. The limbs of the flange define a recess in the form of a channel which extends along the length of the handle. The recess receives and holds the edge portion of the web.

Figure 6A:
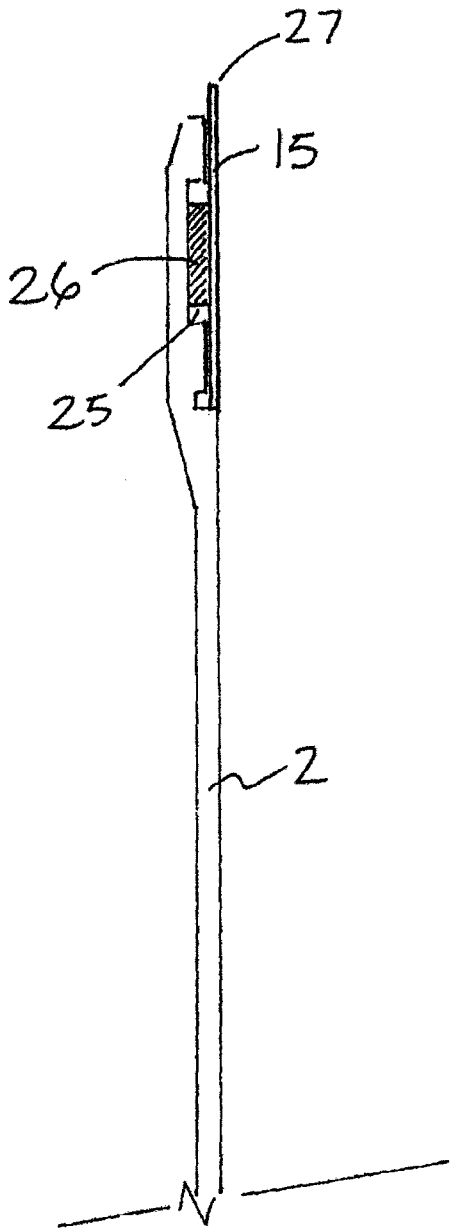
FIG. 6A and 6B are cross-sectional views through blades for use with the tool.

FIG. 6A shows a detailed view of one embodiment of the tool blade. In this preferred version, a thin rectangular stainless steel strip 15 is fixed to the web on one side thereof and extends along the outer part only of the web adjacent to the free edge thereof. The outer part of the web to which the strip is fixed has a thickened profile which is rebated to receive the strip. A channel cut in the rebated portion of the web forms a recess 25 for a double sided adhesive tape 26 which fixes the strip to the web. The outer edge 27 of the strip extends outwardly beyond the free edge of the web. Preferably, the outer edge of the strip extends outwardly beyond the free edge of the strip by more than 1.0 mm and more preferably by about 2.0 mm. This helps in forming a smooth polished surface on the plaster.

The width of the web from the handle to its outer straight edge is preferably 60 to 100 mm, most preferably about 85 mm. The strip covers an outer portion only of the web. The width of the strip is about 10 to 30 mm so that the portion of the web between the handle and the strip which remains uncovered is greater than the width of the strip.

Figure 6B:
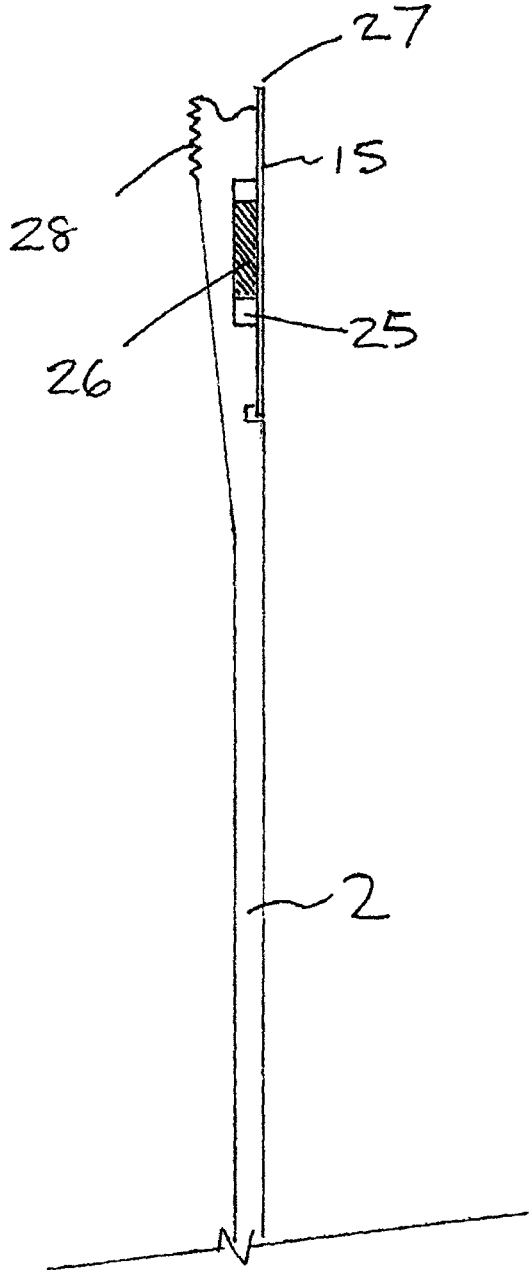

In a yet further variation of the blade shown in FIG. 6B, the outer portion of the web widens outwardly and has ribs 28 running along the length of the blade on the side opposite the strip 15. The ribbed side of the blade is used for applying and roughly smoothing plaster and the other side is used for polishing. The widening of the outer part of the web ensures that the two sides of the web are kept sufficiently far apart at the outer edge of the web so that the overhanging strip does not interfere with the working of the tool when the ribbed side of the web is in use and vice versa.

In an alternative construction (not shown) the handle and web may be formed of a single plastic extrusion formed of a single material, preferably PVC. In another alternative, the handle and web may be made of different plastic materials, or simply of differently coloured plastic materials blending together at a join along the length of the tool.

In a yet further embodiment (not shown) the handle can be solid and made from wood or other suitable material. In this embodiment the web may be extended to overlie the first side of the handle and be glued or otherwise fixed thereto.

Figure 7:
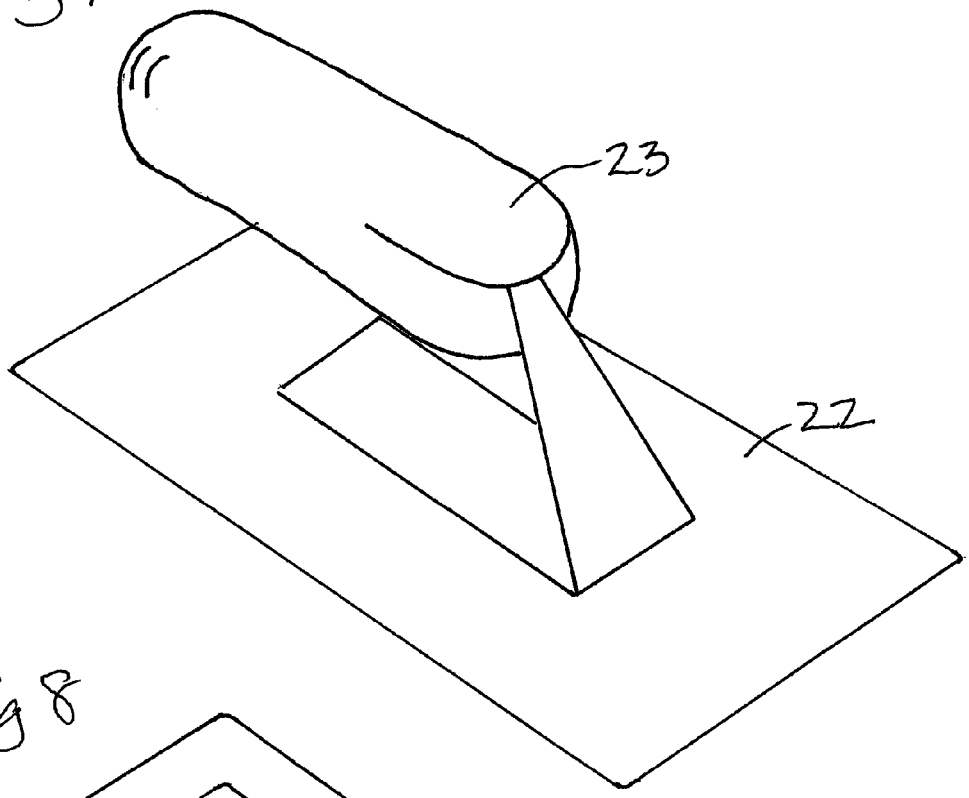
FIG. 7 is a perspective view of a second tool.
Figure 8:
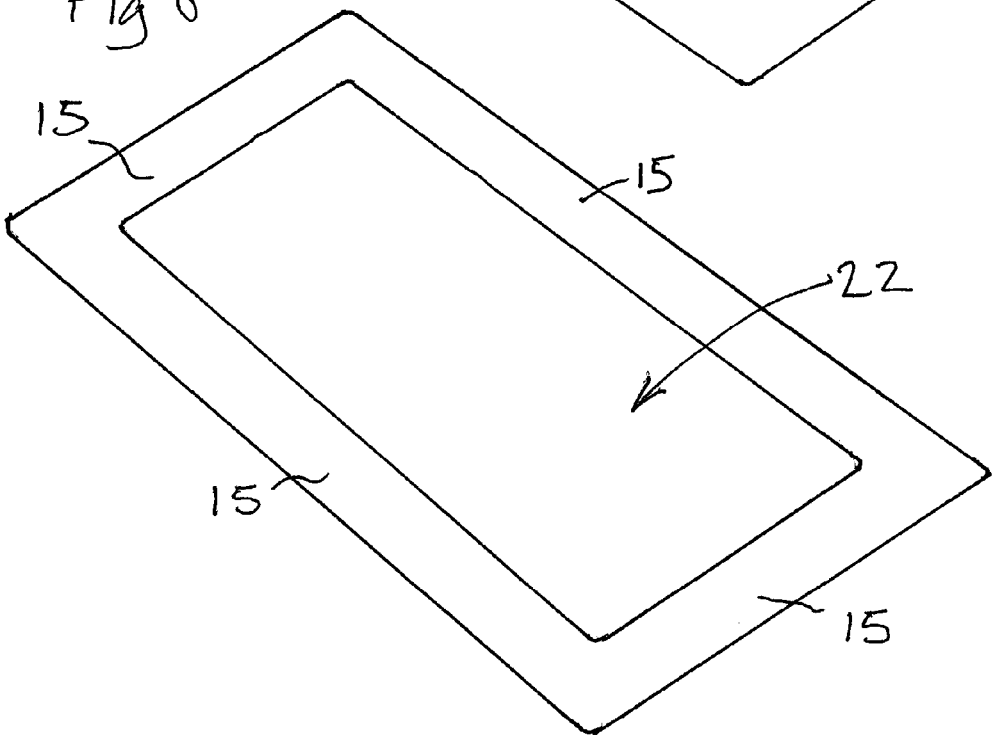
FIG. 8 is an underneath view of the second tool.

A second tool is shown in FIGS. 7 and 8. In this embodiment, the web 22 is rectangular and has strips 15 extending along all four edges thereof on its lower surface. A handle 23 is attached to the upper surface of the web between the strips. The handle can be permanently connected or removable. The four strips may be formed integrally and stamped from a sheet of spring steel or may be formed separately and mitred at the corners of the tool. Strips can be deployed on only one, two, or three edges as necessary for the particular application. The tool shown in FIGS. 7 and 8 is for plaster application, smoothing, finishing and polishing.

In another embodiment, not shown, one or more outer edges of the blade on each embodiment of the tools may be castellated, serrated, have a saw tooth profile, or have any other irregular profile. Such a tool may be useful, for example, for applying tiling cement. Other edge designs can be used for forming decorative patterns in materials.

In all the embodiments, appropriate stainless steel edge strips (or other chosen material) can either be mechanically fixed or glued to be either rigid or to allow free movement between the two materials if necessary in ranging temperatures. The gluing and double sided adhesive tape method of fixing (depending on the thickness and nature of material) may have to be carried out at a controlled temperature when one of the materials is fully contracted. As an example if spring stainless steel is adhered to PVC at a relatively warm temperature, 20 to 30° C., this can result in distortion or buckling if the tool is used at relatively cool temperatures, say 0 to 20° C., because the PVC will contract more than the steel. For this reason, the steel should be adhered to the PVC at a temperature of less than about 20° C.

The invention claimed is:

1. A tool comprising a handle and a generally rectangular tool blade mounted on the handle, wherein the tool blade comprises a rectangular web member formed of flexible material having two opposite inherently flat side surfaces and at least one straight free edge;

wherein an inherently flat strip of a different material is fixed to the web on one of the inherently flat side surfaces thereof and extends along an outer part only of the web adjacent to the free edge thereof, and wherein the strip is formed of metal.

2. A tool as claimed in claim 1, wherein the strip is formed of spring steel.

3. A tool as claimed in claim 1, wherein the web is formed of a polymer such as PVC.

4. A tool as claimed in claim 1, wherein the web is rebated along the free straight edge to receive the strip which is glued or mechanically fixed to the web.

5. A tool as claimed in claim 1, wherein the strip is fixed to the web by means of double sided tape.

6. A tool as claimed in claim 1, wherein the strip extends outwardly beyond the free edge of the web.

7. A tool as claimed in claim 6, wherein the handle is symmetrical so that it can be held from either side.

8. A tool as claimed in claim 1, wherein the web is elongate and wherein the handle is elongate and rigid and is connected to and extends along substantially the length of one long edge of the web opposite to the free edge, wherein the handle is adapted to be gripped by the user at any point along its length.

9. A tool as claimed in claim 8, wherein the handle is formed with a recess extending along the length of the handle; and wherein the edge portion of the web opposite to the free edge is received and held in the recess in a slack fit which permits sliding movement of the edge portion of the web along the length of the recess but prevents movement of the web out of the recess in the direction perpendicular to the length of the recess.

10. A tool as claimed in claim 8, wherein the handle is hollow and is closed off by removable end caps and wherein the end caps, when in place, prevent lengthwise movement of the web out of the recess.

11. A tool as claimed in claim 1, wherein the handle and the web are formed by extrusion.

12. A tool as claimed in claim 1, wherein the web is rectangular and has strips extending along all four edges and wherein a handle is attached to the surface of the web between the strips.

13. A tool as claimed in claim 1, wherein at least one surface of the web is formed with a plurality of parallel ridges extending along the length thereof.

14. A tool as claimed in claim 1, wherein the strip is formed with an irregular outer profile.

15. A tool as claimed in claim 1, wherein portion of the web between the handle and the strip which remains uncovered is greater than the width of the strip.

16. A method of making a tool, the method comprising:

providing a handle and a generally rectangular tool blade comprising a rectangular web member formed a flexible polymer having two opposite inherently flat side surfaces and at least one straight free edge;

fixing an inherently flat strip of metal to the web on one of the inherently flat side surfaces thereof to extend along an outer part only of the web adjacent to the free edge thereof; and mounting the tool blade on the handle such that a portion of the web between the handle and the strip remains uncovered by the strip;

wherein the strip is applied to the web at a temperature of less than about 20° C.

17. A tool comprising a handle and a generally rectangular tool blade mounted on the handle, wherein the tool blade comprises a rectangular web member formed of flexible material having two opposite inherently flat side surfaces and at least one straight free edge;

wherein an inherently flat strip of a different material is fixed to the web on one of the inherently flat side surfaces thereof and extends along an outer part only of the web adjacent to the free edge thereof, and wherein the strip is fixed to the web by double sided tape.

* * * * *